US012753984B2

(12) United States Patent
Snyman

(10) Patent No.: US 12,753,984 B2
(45) Date of Patent: Oct. 6, 2026

(54) FIREARM AND EXTRACTOR, BOLT AND TRIGGER PIN ASSEMBLY

(71) Applicant: Johan Hanno Snyman, Christchurch (NZ)

(72) Inventor: Johan Hanno Snyman, Christchurch (NZ)

( * ) Notice: Subject to any disclaimer, the term of this patent is extended or adjusted under 35 U.S.C. 154(b) by 0 days.

(21) Appl. No.: 18/615,453

(22) Filed: Mar. 25, 2024

(65) Prior Publication Data

US 2025/0297822 A1 Sep. 25, 2025

(51) Int. Cl.
*F41A 15/14* (2006.01)

(52) U.S. Cl.
CPC ..... *F41A 15/14* (2013.01)

(58) Field of Classification Search
CPC ..... F41A 15/14; F41A 15/12; F41A 15/00; F41A 3/22; F41A 3/72
See application file for complete search history.

(56) References Cited

U.S. PATENT DOCUMENTS 2,465,553 A * 3/1949 Robinson, Jr. ..... F41A 15/14 42/25
2,603,019 A * 7/1952 Elkas ..... F41A 15/14 42/25
2,603,020 A * 7/1952 Hussey ..... F41A 15/14 42/25
3,397,473 A * 8/1968 Browning ..... F41A 15/14 42/25
5,926,988 A * 7/1999 Casull ..... F41A 3/72 42/16
6,401,378 B1 * 6/2002 Ockenfuss ..... F41A 17/64 42/70.01
6,886,285 B1 * 5/2005 Sirkis ..... F41A 17/32 42/70.08
8,533,986 B2 * 9/2013 Klotz ..... F41A 3/22 89/1.4
9,038,303 B1 * 5/2015 Olson ..... F41A 15/14 42/25
9,097,478 B1 * 8/2015 Karagias ..... F41A 15/14
9,574,834 B2 * 2/2017 Karagias ..... F41A 15/12
10,458,733 B2 * 10/2019 Karagias ..... F41A 15/10
2010/0180760 A1 * 7/2010 Polston ..... F41A 3/54 89/139

(Continued)

FOREIGN PATENT DOCUMENTS

GB 189320858 A * 5/1894

*Primary Examiner* — Joshua E Freeman
(74) *Attorney, Agent, or Firm* — Leason Ellis LLP

(57) ABSTRACT

A cartridge extractor for positioning about a portion of a firearm bolt includes an outer curved surface that defines an outer perimeter of the annular body, an inner curved surface that defines an inner perimeter of the annular body, a first axial face extending between the outer curved surface and the inner curved surface, and a second axial face extending between the outer curved surface and the inner curved surface and spaced apart from the first face in an axial direction. An extractor arm extends axially from the first axial face and has an engager end distal from the annular body and a cartridge engager flange at the engager end of the extractor arm. Also disclosed are a pin assembly for securing a trigger to a receiver, an adjustable bolt handle which when locked can transfer very high loads, and a firearm.

24 Claims, 6 Drawing Sheets

(56) References Cited

U.S. PATENT DOCUMENTS

| | | | | |
|---|---|---|---|---|
| 2016/0025434 | A1* | 1/2016 | Karagias | F41A 15/14<br>42/25 |
| 2017/0350664 | A1* | 12/2017 | Karagias | F41A 3/22 |
| 2021/0381784 | A1* | 12/2021 | Alomaira | F41A 3/72 |
| 2025/0198713 | A1* | 6/2025 | Jacobson | F41A 15/14 |

* cited by examiner

FIREARM AND EXTRACTOR, BOLT AND TRIGGER PIN ASSEMBLY

FIELD OF TECHNOLOGY

The present technology relates to a cartridge extractor which is compatible with bolt carrier assemblies having a blast plate, with the cartridge extractor being reversibly compatible with bolt heads to allow for the ejection of a cartridge to be set to eject left or right without the use of tools. Another example of the technology relates to a bolt carrier assembly with an adjustable handle which when locked can transfer very high loads. Yet another example of the technology relates to a pin assembly for securing a trigger to a receiver.

BACKGROUND TO THE TECHNOLOGY

Firearms are useful tools for hunting and also providing security. A firearm receiver, or frame, is the part of a firearm which integrates other components by providing housing for internal action and externally attaching components of the firearm. Internal action components include the hammer, bolt, firing pin, ejector and extractor. Externally attaching components include the barrel, stock, trigger mechanism and sights.

After firing cartridge needs to be extracted from the chamber rearwardly in order to reload the chamber with a new cartridge. When a cartridge is fired, the high pressures generated by the ignited propellant to push the projectile through the barrel, results in the cartridge case, typically brass, expanding in the chamber. As a result of this, the cartridge case can become stuck in the chamber and requires a rearward force to be extracted. To facilitate extraction, the cartridge has an extraction rim that can interface with a mechanism to dislodge and eject the cartridge case after firing from the chamber.

There are mainly two types of ejectors, fixed ejectors and plunger style ejectors. A fixed ejector strikes the cartridge case when the bolt reaches a certain point to exert a force in the opposite direction to the travel of the bolt, upon on the cartridge case. These type of fixed ejectors are typically more complicated than a plunger style ejectors, and design concessions are typically made to accommodate for this type of ejection style resulting in a bolt head with reduced structural integrity and robustness. Generally, material needs to be removed from the bolt head in order to accommodate for this type of ejector which provides for a bolt head with reduced structural integrity and may be more prone to metal fatigue. e. Moreover, ejection with fixed ejectors is less consistent as it dependent upon the force applied by the user on the bolt. If the user does not apply sufficient pulling force on the bolt, it can fail to eject. For these reasons, fixed ejectors may be less desirable. A plunger style ejector is typically a spring powdered ejector which is present at the bolt carrier head interface. After firing, when a discharged cartridge is in-line with the ejection port and is clear of the firing chamber, the plunger exerts a force in the opposite direction to the travel of the bolt, upon the cartridge case. Some bolt carrier assemblies with a plunger style ejector may not be configured to internally accommodate a long spring within the bolt head or bolt body. A long spring is an important feature of a plunger ejector, and aids in providing a strong ejection force as well as being more resistant to clogging from brass particles which are generated during the loading, firing, unloading of cartridges from the firearm.

Bolt carrier assemblies for bolt-action rifles may be subjected to a high force from the operator when attempting to remove a cartridge stuck in the firearm after firing. A common high-stress area is the conjunction between the bolt handle of the bolt carrier assembly and the bolt body, due to the force applied to the bolt handle. Overtime, the conjunction between the bolt handle of the bolt carrier assembly and the bolt body may fatigue and result in failure. This conjunction may be strengthened by machining a bolt carrier assembly from a single material, however this does not allow different materials with different advantageous properties for each part of the bolt carrier to be used. In some examples a two-piece assembly also allows the user to customize the bolt knob shape and position. Most commercial bolts are manufactured from at least two pieces, which are either bolted, screwed, locked or welded together.

On some rifles the trigger mechanism is held in place by two pins. In most cases, the pins have a press fit in the receiver to prevent them from backing out while also having a loose fit on the trigger as some of the internal trigger components must be free to rotate around the pins. This is crucial for safety and good function of the trigger. Each manufacturer has its own receiver pin bore spacing and the exact dimension and tolerances of the receiver bores might not be public knowledge. This results in different triggers with different pin hole spacing and hole size, for example, some triggers have 3.200 mm holes, others have 3.175 mm holes. The hole spacing can also differ as much as 0.200 mm. There are various after-market manufacturers of triggers and it can be problematic to get a perfect fit for pins on third party trigger mechanism.

OBJECT OF THE TECHNOLOGY

It is an object of the technology to provide an extractor which may pivotably interface with the rim of a cartridge to dislodge and eject the cartridge case after firing from a chamber.

Alternatively, it is an object of the technology to provide an extractor which does not compromise the form and/or configuration of one or more lugs.

Alternatively, it is an object of the technology to provide an extractor compatible with bolt carrier assemblies with various diameter shafts.

Alternatively, it is an object of the technology to provide an extractor compatible with bolt heads with one or more lugs, and/or multiple rows of lugs.

Alternatively, it is an object of the technology to provide an extractor reversibly compatible with bolt heads to allow for the ejection of a cartridge to be set to eject left or right without the use of tools.

Alternatively, it is an object of the technology to provide a firearm bolt carrier with an adjustable handle which when locked can transfer very high loads.

Alternatively, it is an object of the technology to provide an attachment pin for attaching a trigger mechanism to a firearm receiver.

Alternatively, it is an object of the technology to at least provide the public with a useful choice.

SUMMARY OF THE TECHNOLOGY

According to one example of the technology there is provided a cartridge extractor for a firearm, including:

an incomplete or complete annular body having a first face, second face, an inner surface and an outer surface, the first face and second face being on opposing sides of the annular body, defining a central axis of the annular body which does not bisect the first face and second face, wherein, an elongate member extends from the first face of the annular body, perpendicular to the central axis, and terminates with a rim oriented to be facing radially inward and which extends over the inner surface of the annular body;

the second face of the annular body is positioned with at least one deformable annular member, wherein the angle between the central axis of the annular body and the at least one deformable annular member is between 0.5° to 50.0°±0.2°.

In some examples, the cartridge extractor may provide the same function as both a conventional ejector and a conventional extractor. In other examples, the cartridge extractor may provide the same function as an extractor only. The cartridge extractor may be connected pivotably with the bolt carrier assembly to eject a cartridge. The cartridge extractor and an ejector may work in co-operative manner to eject a cartridge, and may be compatible with a spring ejector or a fixed ejector. The cartridge extractor may be compatible with a modular bolt head and/or a blast plate.

In the extractors of the prior art, large pockets at the bolt head face and/or the locking lugs are commonly used to accommodate the extractor. Advantageously, the cartridge extractor does not compromise or dictate the form and function of the locking lugs or the interface between the cartridge rim and bolt head. This provides a bolt head which is stronger to withstand the forces experienced during firing of the cartridge. The cartridge extractor is compatible is various ejectors, bolt body diameters, modular bolt heads, and blast plates. In some examples, the cartridge extractor is compatible with two-locking lugs and three locking lugs within one row. Due to the compact size of the cartridge extractor, it is possible to include a blast plate behind the interface, which increases the operators' safety in the unlikely event of a catastrophic cartridge case fracture. Moreover, the cartridge extractor may be able to be set to eject left or right without the use of tools. The arrangement of the cartridge extractor with optionally a blast plate and the bolt head allows for the ejection side to be easily set by the facile adjustment of the position of the cartridge extractor relative to the locking lug(s). Moreover, the cartridge extractor may be easily removable without tools to facilitate inspection, cleaning and maintenance.

In some examples, the incomplete or complete annular body of the cartridge extractor is interfaced with a bolt head. When the cartridge extractor is interfaced with a bolt head, such that it is connected pivotably with the bolt carrier, the location of a pivot axis may lie between the rotational circular symmetry axis of the complete annular body, or the corresponding rotational circular C1 axis of symmetry for an incomplete annular body, and the position at where an extractor arm extends axially from the first axial face. As one skilled in the art would understand, the location of a pivot axis may vary depending on the length and position of the extractor arm extending axially from the first axial face of the incomplete or complete annular body, but that the location of a pivot axis lies between the rotational circular symmetry axis of the complete annular body, or the corresponding rotational circular C1 axis of symmetry for an incomplete annular body, and the position at where an extractor arm extends axially from the first axial face. Preferably the pivot axis of the cartridge extractor when interfaced with a bolt head location is not positioned at where an extractor arm extends axially from the first axial face, however it may be located at or near the rotational circular symmetry axis of the complete annular body, or the corresponding rotational circular C1 axis of symmetry for an incomplete annular body.

As one skilled in the art would appreciate, the cartridge extractor of the present invention can be sized appropriately for the cartridge and allows for efficient and reliable ejection of small and larger calibre cartridges.

The annular body may be incomplete and may not form an enclosed continuous loop. The incomplete annular body may be 60, 70, 80, 90, 95% of a complete annular body. In some examples, the cartridge extractor may be integrally formed. In some examples, the cartridge extractor may be formed from separately formed components.

In some examples, the annular body having a first face, second face may be dimensionally the same or different. In some examples, the annular body may have an outer diameter which is larger than an inner diameter. In some examples, the annular body may have an outer diameter of between 8 mm-150 mm+2 mm. In some examples, the annular body may have an inner diameter of between 8 mm-150 mm+2 mm. In some examples, the annular body having an inner surface and an outer surface may have the same thickness or may be different. In some examples, the thickness of the inner surface may be between 1 mm-100 mm+2 mm. In some examples, the thickness of the outer surface may be between 1 mm-100 mm+2 mm. In some examples, the elongate member may extend perpendicular to the central axis of the annular body, between 0.5 mm-150 mm+0.2 mm from the first face of the annular body. In some examples, the cartridge extractor rim oriented to be facing radially inward may be bevelled.

In some examples, the cartridge extractor may be manufactured from a single material. In some examples, the cartridge extractor may be manufactured from at least one material. In some examples, the cartridge extractor may be milled, cast, forged or printed from at least one material. In some examples, the cartridge extractor comprises an alloy including at least one of aluminium, titanium, chromium, manganese, iron, cobalt, nickel, copper, zinc, zirconium, molybdenum, ruthenium, tin. In some examples, the cartridge extractor is formed from an alloy of aluminium, titanium, stainless steel, or steel.

According to another example of the technology there is provided a firearm bolt carrier including:

a cylindrical bolt body positioned with a bolt head, wherein the bolt head is configured to receive in use a case rim of a cartridge, and the cylindrical bolt body is configured to receive a handle, wherein, the cylindrical bolt body and handle each comprise complimentary annular facets with tapered serrations.

In some examples, the firearm bolt carrier with a cylindrical bolt and handle may be reversibly fastened by a threaded fastener. In other examples, the firearm bolt carrier with a cylindrical bolt and handle may be reversibly fastened by a mortice hook lock. In some examples, the handle may be in a swept-back configuration and may allow for quicker bolt carrier assembly manipulation and/or provide a more ergonomic and natural setup during the use of the firearm.

In some examples, the cylindrical bolt body and handle may each comprise complimentary annular facets with tapered serrations. In some examples, the tapered serrations may be symmetrical or may be asymmetrical. In some examples, the tapered serrations are radial grooves. In some examples, the complementary tapered serrations are between the cylindrical bolt body and handle may form a hirth coupling or a curvic coupling. In some examples, the annular facets may have an outer diameter of between 10 mm-100 mm+2 mm. In some examples, the annular body may have an inner diameter of between 10 mm-100 mm+2 mm.

Advantageously, the present technology allows for the cylindrical bolt body and handle to each be exchanged overtime, such as when switching between different firearms, or firearm operators. It may be desirable to switch between various handles depending on which individual is using the firearm and their preference or type of shooting they are performing. Clearly this exchangeability of component parts allows increased resource efficiency and/or facilitates the rapid adaptation of the firearm to adjust the ergonomics. Furthermore, the complimentary annular facets with tapered serrations on the cylindrical bolt body and handle, allows for the transfer of high forces without damage to either the cylindrical bolt body and handle.

According to another example of the technology there is provided a cartridge extractor for temporarily engaging an ammunition cartridge during a firing cycle of a firearm, the cartridge extractor including: an annular body for positioning about a portion of a firearm bolt, the extractor including:

an outer curved surface that defines an outer perimeter of the annular body, an inner curved surface that defines an inner perimeter of the annular body a first axial face extending between the outer curved surface and the inner curved surface, and a second axial face extending between the outer curved surface and the inner curved surface and spaced apart from the first face in an axial direction, an extractor arm extending axially from the first axial face, the extractor arm having an engager end distal from the annular body, and a cartridge engager flange at the engager end.

According to another example there is provided a firearm bolt comprising a generally cylindrical bolt body having a first end and a second end, a bolt head at the first end of the bolt body, a bolt handle at the second end of bolt body, and a cartridge extractor adjacent the bolt head, the cartridge extractor including:

an annular body for positioning about a portion of the bolt body, an outer curved surface that defines an outer perimeter of the annular body, an inner curved surface that defines an inner perimeter of the annular body, a first axial face extending between the outer curved surface and the inner curved surface, a second axial face extending between the outer curved surface and the inner curved surface and spaced apart from the first face in an axial direction, an extractor arm extending axially from the first axial face, the extractor arm having an engager end distal from the annular body, wherein, the cartridge extractor is biased to have its first axial face bear against the bolt head.

According to yet another example there is provided a firearm having a bolt reciprocatingly sliding axially along a bolt axis, said bolt temporarily engaging an ammunition cartridge at a distal bolt head during a firing cycle of the firearm, wherein said ammunition cartridge includes a case portion having a proximal rim adjacent to a circumferential groove: an extractor including an outer curved surface that defines an outer perimeter of the annular body, an inner curved surface that defines an inner perimeter of the annular body a first axial face extending between the outer curved surface and the inner curved surface, and a second axial face extending between the outer curved surface and the inner curved surface and spaced apart from the first face in an axial direction, an extractor arm extending axially from the first axial face, the extractor arm having an engager end distal from the annular body, and a cartridge engager flange at the engager end.

According to yet another example there is provided a firearm having a receiver for a bolt reciprocatingly sliding axially along a bolt axis, the bolt temporarily engaging a cartridge case at a distal bolt head during a firing cycle of the firearm, the bolt having a firing pin for striking the cartridge case, and a trigger mechanism engageable with the receiver and bolt for causing the firing pin to strike the cartridge case, wherein the trigger mechanism is engageable with the receiver by a securing pin that engages apertures in the received and trigger mechanism, wherein the securing pin has a first diameter portion for engaging a first receiver aperture, second diameter portion for receiving a trigger mechanism aperture and a third diameter portion for engaging a second receiver aperture, and wherein the first diameter portion has a first diameter, the second diameter portion has a second diameter larger than the first diameter, and the third diameter portion has a third diameter larger than the second diameter Further examples of the technology, which should be considered in all its novel examples, will become apparent to those skilled in the art upon reading of the following description which provides at least one example of a practical application of the technology.

BRIEF DESCRIPTION OF THE DRAWINGS

One or more embodiments of the technology will be described below by way of example only, and without intending to be limiting, with reference to the following drawings, in which.

DETAILED DESCRIPTION OF PREFERRED EMBODIMENTS OF THE TECHNOLOGY

Figure 1:
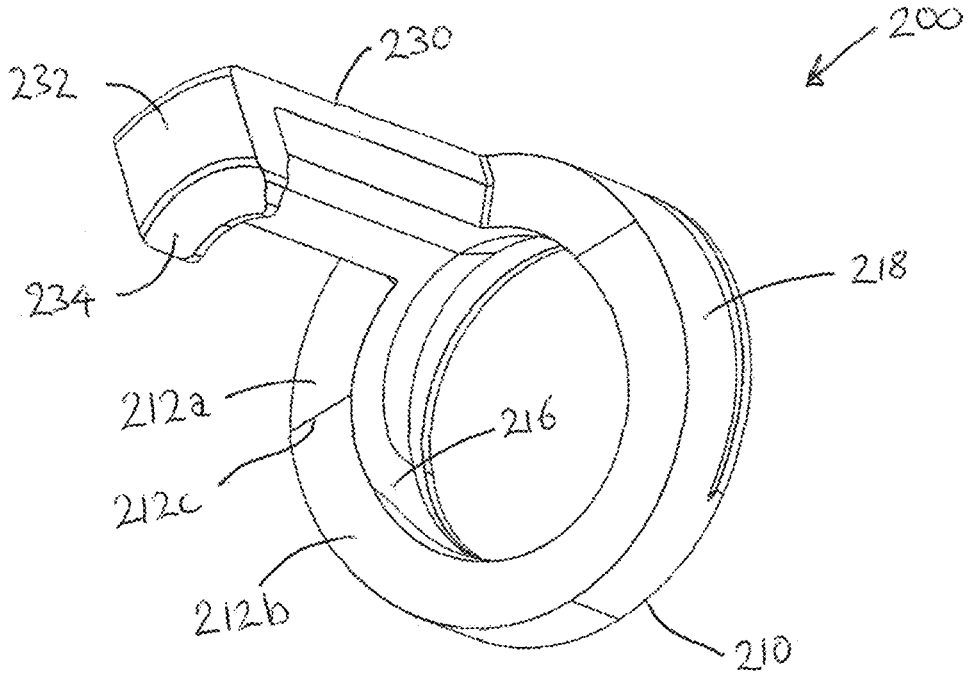
FIG. 1. shows a first perspective view of an embodiment of the cartridge extractor, FIG. 2. shows a side view of an embodiment of the cartridge extractor, FIG. 3. shows a second perspective view of an embodiment of the cartridge extractor, FIG. 4. shows an end view of an embodiment of the cartridge extractor, FIG. 5. shows one embodiment of the cartridge extractor adapted for a bolt head with three locking lugs in one row and wherein the bolt head also includes a blast plate.
Figure 2:
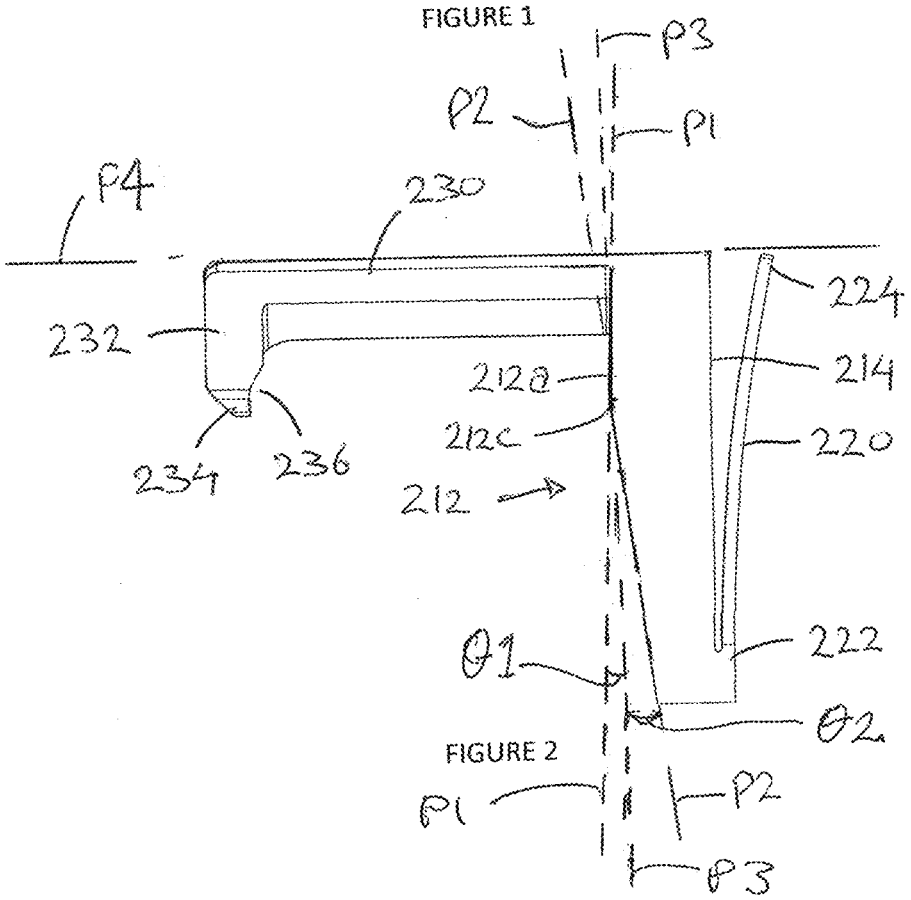
Figure 3:
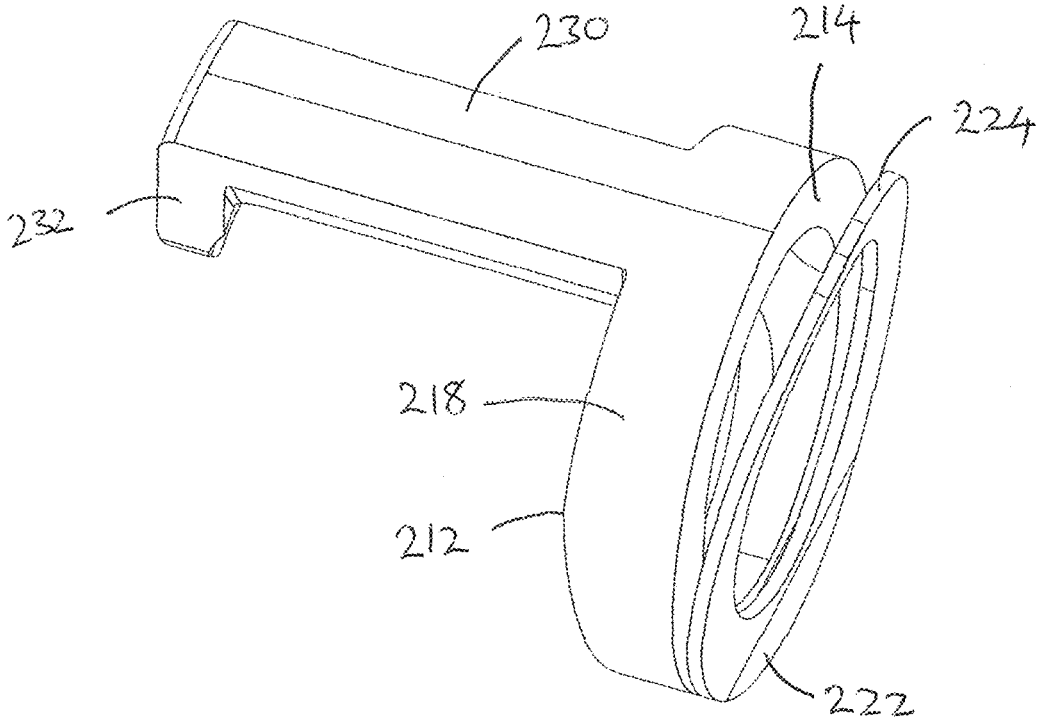
Figure 4:
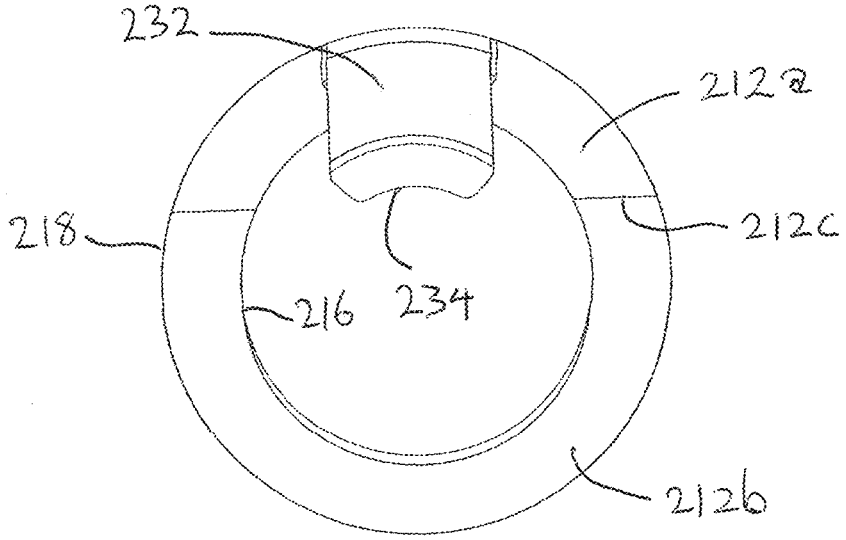
Figure 5:
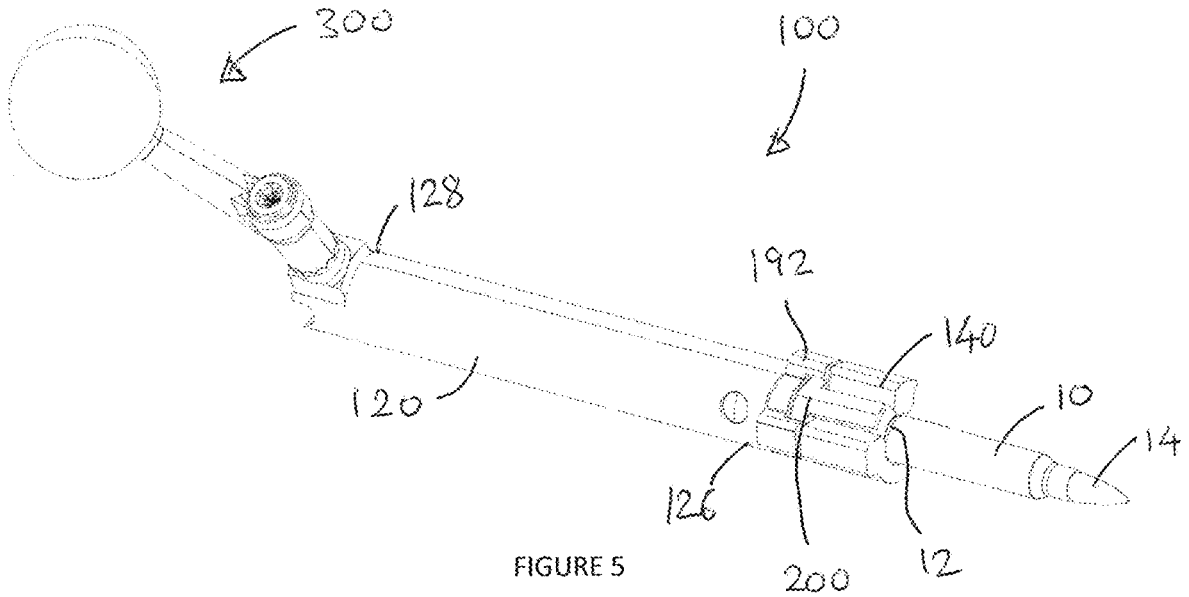
Figure 6:
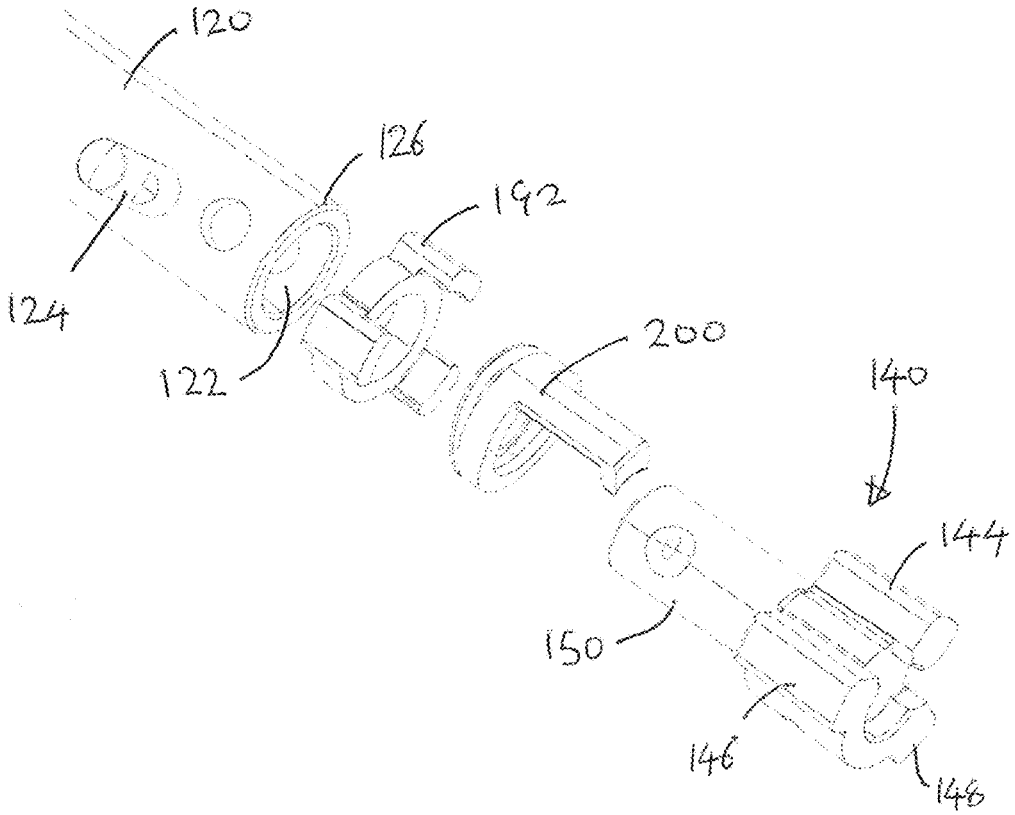
FIG. 6. shows an exploded view of one embodiment of the cartridge extractor adapted for a bolt head with three locking lugs in one row and wherein the bolt head also includes a blast plate, FIG. 7. shows a second view of the cartridge extractor adapted for a bolt head with three locking lugs in one row and wherein the bolt head also includes a blast plate, shows a cross-sectional view of one embodiment of the cartridge extractor, showing FIG. 8. the pivot axis of the cartridge extractor and rim or extractor groove of a cartridge interfaced with the rim of the cartridge extractor which is oriented to be facing radially inward, FIG. 9. shows a bolt carrier assembly according to one embodiment of the technology, wherein the cylindrical bolt body is configured to receive a handle and the bolt body and handle comprise complimentary annular facets with tapered serrations, FIG. 10. shows an example of securing a trigger mechanism to a firearm receiver.
Figure 7:
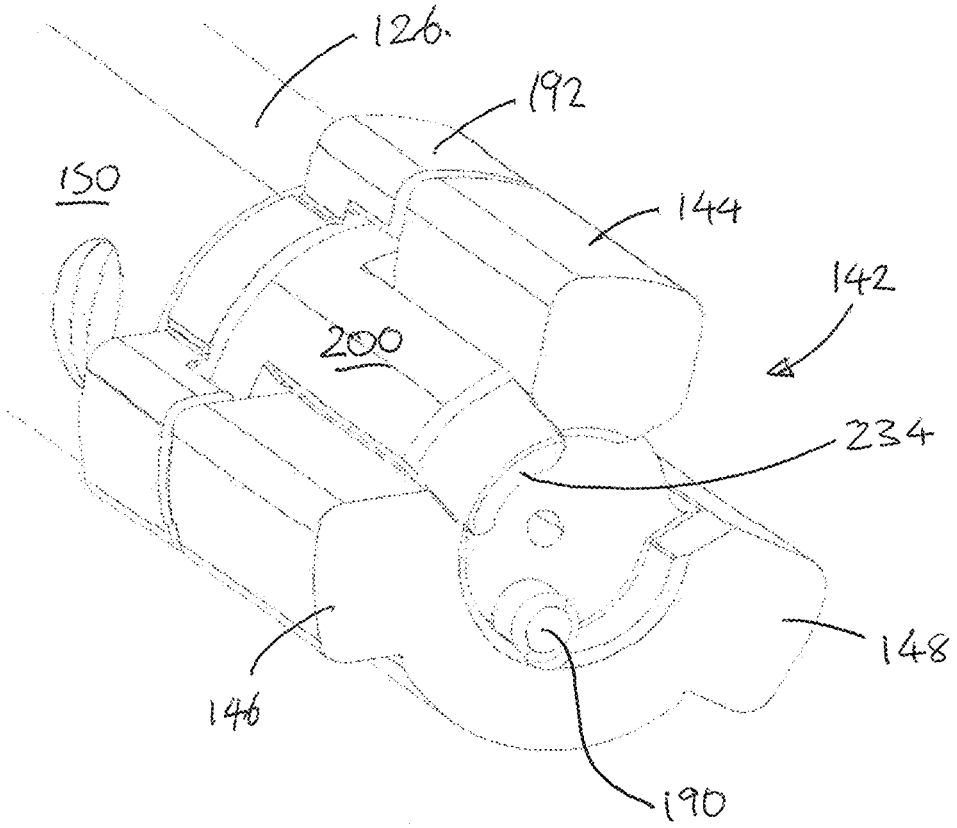

A firearm receiver, or frame, is the part of a firearm which integrates other components by providing housing for internal action and externally attaching components of the firearm. Internal action components include the hammer, bolt, firing pin, ejector and extractor. Externally attaching components include the barrel, stock, trigger mechanism and sights.

Semi-automatic, automatic and many bolt-action rifles use a bolt carrier assembly 100. A bolt carrier assembly 100 comprises a bolt body 120 and a bolt head 140, and may be manufactured from a single piece of material or two separate parts which are then joined together. In a two part configuration the bolt head 140 has a shaft member 150 arranged to locate within a receiving aperture 122 in a distal end of the bolt shaft 120. A pin 124 passing through the distal end 126 of the bolt shaft 120 secures the bolt head to the bolt shaft. The bolt head 140 may have an interface 142 which is configured to cooperate with the case rim 12 of a cartridge 10 to aid in manipulating the movement of the cartridge 10 within the chamber. The bolt carrier heads 140 have various configurations to interface between the case rim 12 of a cartridge 10 and the bolt carrier 100, and the specific configuration may depend on the type of cartridge used and the desired accuracy and/or rate of fire. The bolt carrier head interface 142 typically include both an extractor 200 and an ejector 190. The ejector at a bolt carrier interface commonly is spring loaded and configured to releasably engage a cartridge. Whereas the extractor 200 is configured to interface with a cartridge 10 and/or a cartridge rim 12. The extractor may have a claw-like mechanism. The extractor 200 of the present invention is compatible with a variety of different ejectors, including those which are fixed and spring loaded.

The bolt head 140 includes multiple lugs 144, 146, 148 that interlock with corresponding grooves of a barrel receiver attached to a barrel breech and chamber (not shown), that can contain a cartridge 10 before it is discharged. When the rifle is fired, the firing force is transmitted to the interlocked bolt head 140 through the secured lugs 144, 146, 148. The bolt carrier assembly 100 may include a rotating mechanism 300 allowing for the bolt head 140 to be rotatably interlocked with the barrel receiver during a loading step and may be rotatably unlocked by reversing motion to disengage the bolt head 140 from the barrel in order to extract a cartridge casing 10 from the chamber after the cartridge has been discharged. In some examples the bolt carrier assembly 100 may not include a rotating mechanism and is configured for the bolt carrier to be pushed and pulled axially within the barrel. This is commonly referred to as a straight pull mechanism.

After firing and disengagement of a bolt carrier assembly 100 from the corresponding grooves of a receiver or barrel extension depending on the design of the firearm, the bolt carrier assembly 100 is moved rearwardly to extract the exhausted cartridge case 10 from the firing chamber. During firing the cartridge casing 10, containing the explosive charge, is forced outwardly against the inner walls of the chamber helping seal the chamber and forcing the projectile 14 along the barrel. The extractor 200 grips the rim 12 of the cartridge 10 to aid in its extraction from the barrel chamber as the bolt 100 is moved rearwardly. With a mechanical ejector, the rearward movement of the bolt is halted by contacting a backstop, which results in the ejector ejecting the cartridge casing from the chamber breech. For a plunger style ejector, the case is ejected as soon as the case clears the ejection port, and the bolt carrier does not need to make contact with the backstop to eject the case. The ejector may exert a pushing force on the cartridge to facilitate in ejecting the cartridge. Once the exhausted cartridge has been cleared from the chamber, a new cartridge may be either automatically or manually loaded in its place. This process can be repeated as necessary.

The bolt carrier assembly 100 may have a shaft body 120 with a smaller diameter than the locking lugs, or alternatively may have a shaft diameter which is the same diameter as the locking lugs. The diameter of the shaft body 120 affects the type of locking lug configurations which can be used at a bolt carrier interface. Moreover, it is the locking lug configuration which dictates the shape and orientation of an extractor and/or ejector at a bolt carrier interface. The total number of locking lugs and the number of rows. This also plays a role in what type of extractor will work best.

The number of different locking lugs at a bolt carrier interface can vary greatly, from firearms with one locking lug, to up to twelve. Additional rows of locking lugs can be included at the bolt head 140 to ensure a secure lock between the bolt carrier assembly 100 and barrel receiver when full diameter bolt is used with a small diameter. The number of locking lug rows influences the bolt rotation, this is the total angle that a bolt needs to rotate to unlock the bolt from the barrel receiver. In general, two lugs in a one row require 90° of rotation to unlock and lock the bolt carrier assembly 100 from the barrel receiver, three lugs require 60° of rotation to lock and unlock, whilst four lugs require 45° of rotation to unlock and lock. For a bolt action rifle, the smaller the angle, the less hand movement is necessary to unlock the bolt. This aids in cycling the bolt faster and may reduce the time taken to reload the rifle. A smaller bolt rotation also provides a greater clearance between the bolt knob and scope, which reduces the likelihood of the operator marring their fingers whilst operating the bolt under stress.

A blast plate 192 can be incorporated in bolt carrier assemblies which have a shaft body that is smaller diameter than the locking lugs. The blast plate 192 also has radial lugs corresponding with the locking lugs. A blast plate 192 ensures that in the unlikely event of a catastrophic cartridge case fracture during firing, that less fragments from the cartridge pass through the race ways which could harm the operator or bystanders.

In FIGS. 1 to 4 there is shown a cartridge extractor 200 including an annual (ring shaped) body 210 having a first axial face 212, a second axial face 214, an inner curved surface 216 that defines an inner perimeter of the annular body, and an outer curved surface 218 that defines an outer perimeter of the annular body. The first axial face 212 extends between the outer curved surface 218 and the inner curved surface 216. The second axial face 214 extends between the outer curved surface 218 and the inner curved surface 216 and is spaced apart from the first axial face 212 in an axial direction. The first axial face 212 and second axial face 214 are on opposing sides of the annular body 210.

In some examples, the first axial face 212 has a first axial face portion 212*a* define a first generally radial plane P1 and a second axial face portion 212*b* defining a second generally radial plane P2. The first generally radial plane P1 forms an acute angle theta-1 (Θ1) to a plane P3 perpendicular with a longitudinal axis of the annular body. The second generally radial plane P2 lies at an acute angle theta-2 (Θ2) to the plane P3. An intersection between the first axial face 212*a* portion and the second axial face 212*b* portion defines a ridge 212*c* about which the cartridge extractor 200 can pivot against the head 140 of a firearm bolt 100. In some examples the first angle theta-1 (Θ1) is smaller than the second angle theta-2 (Θ2). In some examples first angle theta-1 (Θ1) is in the range of 1-5 degrees, and second angle theta-2 (Θ2) is in the rage of 3 to 10 degrees. In some examples first angle theta-1 (Θ1) is about 3 degrees, and second angle theta-2 (Θ2) is about 5 degrees.

The extractor 200 also includes a resiliently deformable biasing member 220 that extends from the second axial face 214 diametrically opposite to a position where an extractor arm 230 extends axially from the first axial face 212. In some examples the resiliently deformable biasing member 220 includes an annular body. A circumferential portion 222 of the biasing member annular body 220 is connected with the second axial face 214 of the body at a position diametrically opposite to a position where the extractor arm extends axially from the first axial face 212. The circumferential dimensions of the biasing member annular body are the same as the circumferential dimensions of the extractor annular body. In some examples the resiliently deformable biasing member 220 may be curved in a radial direction such that a second circumferential portion 224 of the biasing member annular body opposite the circumferential portion 222 connected with the second axial face 214 of the body is spaced further from the second axial face 214. The cartridge extractor 200 may be positioned between an optional blast plate 192 of a firearm bolt 100 and a head 140 of a firearm bolt 100 such that the resiliently deformable biasing member engages blast plate 192 and biases the first axial face portion 212*a* towards the head 140 of the firearm bolt. In some examples, the extractor can work with any spring element, be it a linear coil spring, torsion spring, live spring, leaf spring, extension spring etc. In some examples the bolt head shaft member 150 passes through the annular body 210 of the extractor 200 to secure the extractor with the bolt.

In some examples the extractor arm 230 extends axially from the first axial face 212. In some examples the extractor arm extends from the first axial face 212 portion along longitudinal plane P4 generally tangential with the outer curved surface 218. The extractor arm has an engager end 232 distal from the annular body 210. At the distal end is a cartridge engager flange 234 that extends inwardly towards a central axis of the extractor. The engager flange includes a hook or claw, and a notch or channel adjacent the hook or claw configured to engage with a rim 12 of an ammunition cartridge 10. In use, when the bolt is closed on an ammunition cartridge the extractor pivots about ridge 212*c* as the engager flange 234 engages with a rim 12 of the cartridge case, and is biased with the first axial face portion 212*a* towards the bolt head 140. The extractor annular body lies along a plane generally perpendicular with a plane intersecting a longitudinal axis of the annular body (the longitudinal axis of the annular body being coincident with a longitudinal axis of the bolt). The longitudinal plane P4 tangential with the outer curved surface is generally parallel to the longitudinal axis of the annular body. The engager flange 234 engages with a rim 12 of the cartridge case. After firing the cartridge case is frictionally engaged within the receiver. When the bolt is retracted to open the firearm breech the engager flange 234 holds the cartridge rim to extract it from the receiver. As the rim of the cartridge causes a resistive force on the retracting engager flange 234, first axial face portion 212*a* is able to pivot towards the bolt head such that the extractor 200 and engager flange 234 pivot (rotate) inwards exerting a greater engaging force on the cartridge rim to extract the cartridge. When the bolt if fully unlocked the cartridge is no longer constrained by the receiver the ejector cause the cartridge to be ejected from the ejection port of the receiver.

FIGS. 5 through 8 illustrate a bolt for a firearm 100. In the firearm the bolt 100 is reciprocatingly slideable axially along a bolt axis. The bolt temporarily engages a cartridge case 10/12 at a distal bolt head 140 during a firing cycle of the firearm. The cartridge case 10 includes a case portion having a proximal rim 12 adjacent to a circumferential groove.

The firearm bolt includes a generally cylindrical bolt body 120 having a distal end 126 and a proximal end 128, and a bolt longitudinal axis. The firearm bolt also includes a bolt head 140 at the distal end of the bolt body 120 and a bolt handle 300 at the proximal end of bolt body 120. In some examples the bolt 100 includes a cartridge extractor 200 between the bolt body 120 and the bolt head 140. In some examples the cartridge extractor 200 includes an annular body 210 for positioning about a connecting portion (in some examples 150) of the bolt head 140 with the bolt body 120.

In some examples the bolt 100 includes a blast plate 192 between the bolt head 140 and bolt body 120. The cartridge extractor 200 is positioned between the blast plate 192 and a bolt head 140 with the resiliently deformable biasing member engaging the blast plate to bias the first axial face 212 portion against the bolt head 140. In some examples the blast plate 192 includes an annular body 210 for positioning about a connecting portion (in some examples 150) of the bolt head 140 with the bolt body 120.

In some examples a cartridge engager flange at the engager end, the cartridge engager flange including a hook or claw, and a notch or channel adjacent the hook or claw, to engage a cartridge case rim.

Figure 8:
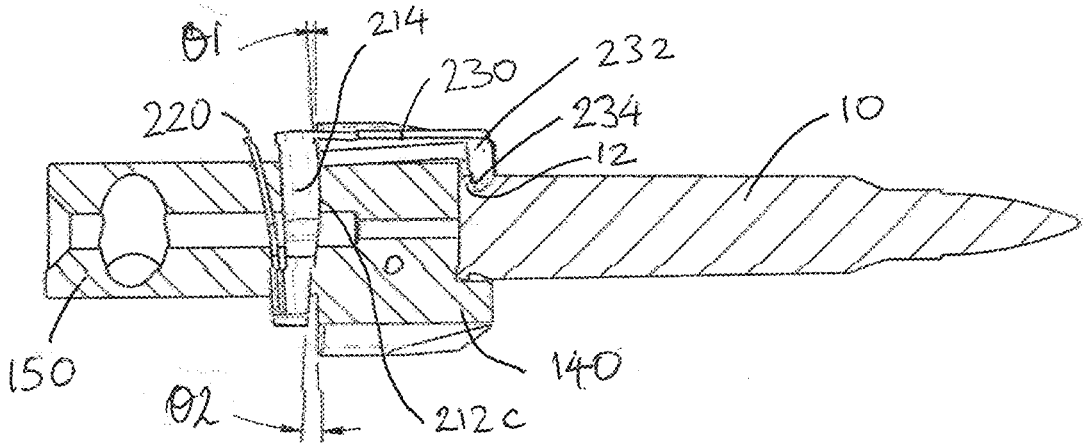
Figure 9:
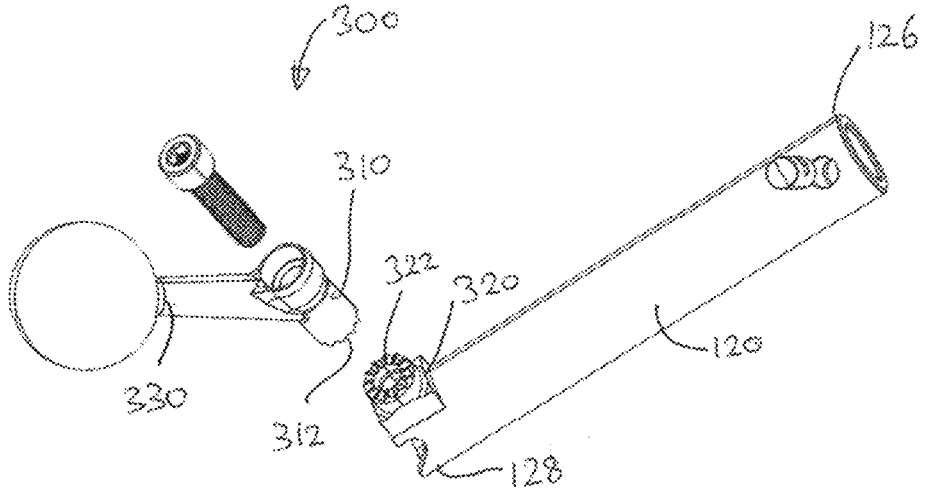

Referring to FIG. 8, in some examples the bolt handle includes a boss portion 210/320 extending radially from the bolt body 120 coincident with a plane intersecting a longitudinal axis of the bolt. A grippable portion 330 extends from the boss portion at an acute angle to the plane. The grippable portion is adjustable connected with the boss by a rotatable joint. In some examples the rotatable joint includes an engageable face 312 having a plurality of circumferential spaced detent positions, and an engageable face 322 engageable with the engageable face 312 in any one of the plurality of circumferential spaced positions. The grippable portion 330 extends at an acute angle to an axis of the boss portion. The grippable portion 330 is adjustable with respect to the boss portion between the plurality of circumferential spaced positions, each of which results in the grippable portion of the bolt handle 300 extending at a different (acute) angle to a plane intersecting a longitudinal axis of the bolt. This adjustability of the body handle 300 allows it to be adjusted to suit different individuals and personal preferences.

Figure 10:
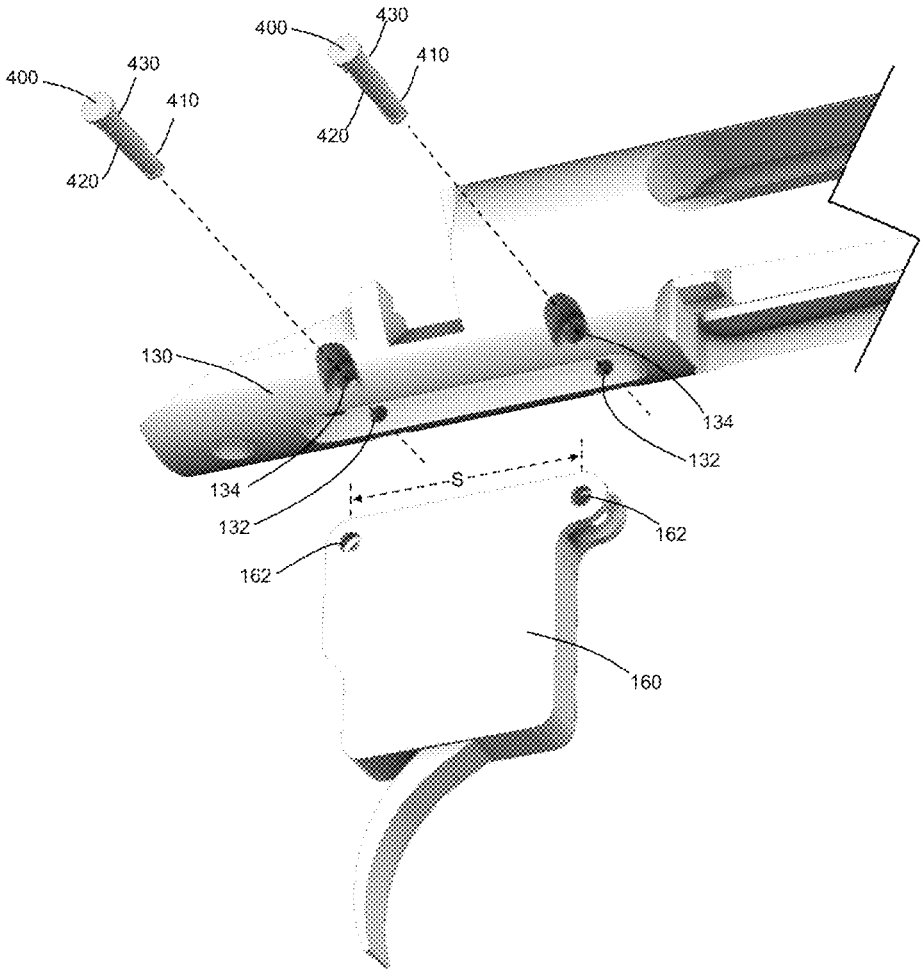
Figure 11:
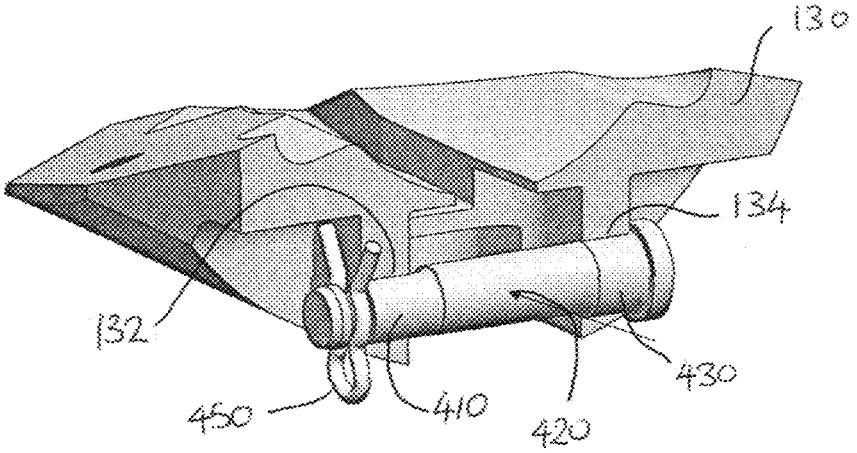
FIG. 11 shows a section view of the example of securing a trigger mechanism to a firearm receiver, and FIG. 12. shows an example of a securing pin for securing a trigger mechanism to a bolt carrier.
Figure 12:
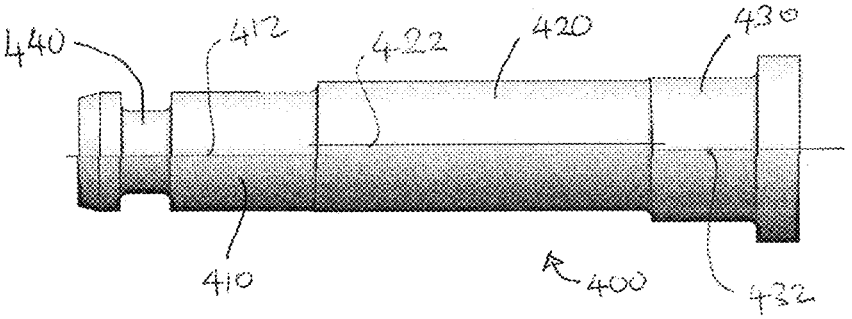

Referring to FIGS. 10 and 12 in some examples a trigger mechanism 160 may be secured to the receiver 130. The trigger is held in place by two cross pins 400 sufficiently secured to prevent the pins backing-out. This is crucial for safety and good function of the trigger 160. It must also be noted that the pins 400 must have a loose fit on the trigger as some of the internal trigger components must be free to rotate around the pin 400. In some examples the pins 400 have three sections 410, 420, 430 each with increasing diameters. This allows the engineer to control the fit of the pins to the receiver 130 independently to the fit of the trigger 160. Typically a trigger will have a pair of securing apertures 162 with an aperture diameter of 3.175 mm. Other triggers have a securing aperture diameter of 3.2 mm.

In the present technology the receiver 130 has a pair of first receiver securing apertures 132 with an aperture diameter of less than 3.175 mm, and a pair of second receiver securing apertures 134 with and aperture diameter of greater than 3.2 mm. The securing pin has three sections 410, 420, 430 each with increasing diameters. A first distal section 410 has a diameter of less than 3.175 mm for matching with the first receiver securing apertures 132. A third proximal section 430 has a diameter of greater than 3.2 mm for matching with the second receiver securing apertures 134. The third centre section 420 of the pin has a diameter of 3.175 mm or 3.2 mm, as required, to cooperate with a corresponding trigger securing aperture 162. Each pin 400 has a circumferential groove 440 to allow it to be retained with a spring pin 450 to prevent it from falling out.

In some examples the centre section 420 has a central axis 422 that is eccentric relative to a central axis 412 of first distal section 410 and central axis 432 of the third proximal section 430. As noted earlier, different triggers may have different pin aperture 162 spacing(S) and aperture 162 size, for example, some triggers have 3.200 mm holes, others have 3.175 mm holes. The hole spacing can also differ as much as 0.200 mm. Rotating one or both pins 400 moves the position of the centre section 420 relative to the receiver securing apertures 132, 134 to accommodate triggers with different hole spacings S. This can be used to account for triggers with different hole spacing S.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

The entire disclosures of all applications, patents and publications cited above and below, if any, are herein incorporated by reference.

Reference to any prior art in this specification is not, and should not be taken as, an acknowledgement or any form of suggestion that that prior art forms part of the common general knowledge in the field of endeavour in any country in the world.

The technology may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the technology and without diminishing its attendant advantages. It is therefore intended that such changes and modifications be included within the present technology.

What is claimed is:

1. A cartridge extractor for temporarily engaging a cartridge case during a firing cycle of a firearm, the cartridge extractor including:

a unitary annular extractor body for positioning about a portion of a firearm bolt, the annular extractor body including an outer curved surface that defines an outer perimeter of the annular extractor body, an inner curved surface that defines an inner perimeter of the annular extractor body, a first axial face extending between the outer curved surface and the inner curved surface, a second axial face extending between the outer curved surface and the inner curved surface and spaced apart from the first axial face in an axial direction, an arm extending axially from the first axial face, the arm having a cartridge engager flange distal from the annular extractor body, wherein the annular extractor body is pivotably mounted relative to a head of the firearm bolt and is configured to pivot between a cartridge engagement position and a cartridge disengagement position.

2. The cartridge extractor of claim 1, wherein the first axial face includes a bearing profile defining a localised contact region about which the annular extractor body bears and pivots against a head of a firearm bolt.

3. The cartridge extractor of claim 1, wherein the first axial face has a first axial face portion defining a first generally radial plane, and a second axial face portion defining a second generally radial plane, an intersection between the first axial face portion and the second axial face portion defining the localised contact region about which the annular extractor body bears and pivots against a head of a firearm bolt.

4. The cartridge extractor of claim 3, wherein:

the cartridge engager flange extends radially inwards from the extractor arm towards a cartridge engagement location, in the cartridge engagement position of the annular body the cartridge engager flange is at the cartridge engagement location, and the cartridge engagement location is between a longitudinal plane passing through the ridge and a longitudinal plane tangential with the outer curved surface of the annular body.

5. The cartridge extractor of claim 4, wherein the cartridge engager flange includes a hook or claw.

6. The cartridge extractor of claim 5, wherein cartridge engager flange further includes a notch or channel adjacent the hook or claw.

7. The cartridge extractor of claim 4, further including a resiliently deformable biasing member resiliently biasing the annular body towards the cartridge engagement position.

8. The cartridge extractor of claim 7, wherein the resiliently deformable biasing member engages a portion of the bolt and biases the first axial face portion against the head of a firearm bolt.

9. The cartridge extractor of claim 7, wherein the resiliently deformable biasing member includes a spring, or a belleville washer, or a slotted disc spring, or a contact disc spring, or a curved disc spring, or a wave disc spring, or a finger spring washer.

10. The cartridge extractor of claim 7, wherein the resiliently deformable biasing member includes leaf-type spring extending from the second axial face diametrically opposite to a position where the extractor arm extends axially from the first axial face.

11. The cartridge extractor of claim 10, wherein the leaf-type spring includes an annular body, a circumferential portion of the annular body connected with the second axial face diametrically opposite to a position where the extractor arm extends axially from the first axial face.

12. The cartridge extractor of claim 11, wherein the cartridge extractor is, in use, positioned between a blast plate portion of a firearm bolt and a head of a firearm bolt, the resiliently deformable biasing member engages blast plate portion and biases the first axial face portion against the head of the firearm bolt.

13. The cartridge extractor of claim 1, wherein the extractor arm extends from the first axial face portion along a longitudinal plane tangential with the outer curved surface.

14. The cartridge extractor of claim 1, wherein the annular body is an incomplete annular body including a break in the outer and outer perimeter of the body.

15. The cartridge extractor of claim 1, wherein:

the cartridge engager flange extends radially inwards from the extractor arm towards a cartridge engagement location, in the cartridge engagement position of the annular body the cartridge engager flange is at the cartridge engagement location, the extractor arm is tapered from the first axial face towards engager end distal from the annular body, wherein a radially inner face of the extractor arm is generally parallel with a longitudinal plane tangential with the outer curved surface of the annular body.

16. A firearm bolt comprising:

a generally cylindrical bolt body having a first end and a second end, a bolt head at the first end of the bolt body, a bolt handle at the second end of bolt body, and a unitary annular extractor body for positioning about a portion of the cylindrical bolt body, the annular extractor body including an outer curved surface that defines an outer perimeter of the annular extractor body, an inner curved surface that defines an inner perimeter of the annular extractor body, a first axial face extending between the outer curved surface and the inner curved surface, a second axial face extending between the outer curved surface and the inner curved surface and spaced apart from the first axial face in an axial direction, an arm extending axially from the first axial face, the arm having a cartridge engager flange distal from the annular extractor body, wherein the annular extractor body, wherein, the cartridge extractor is pivotably mounted relative a bolt head and is configured to pivot between a cartridge engagement position and a cartridge disengagement position.

17. The firearm bolt of claim 16, wherein when the cartridge extractor is interfaced with the bolt head, such that it is pivotably arranged with the bolt carrier, the location of a pivot axis is between the rotational circular symmetry axis of the complete annular body, or the corresponding rotational circular axis of symmetry for an incomplete annular body, and the position at where an extractor arm extends axially from the first axial face.

18. The firearm bolt of claim 16, further including a resiliently deformable biasing member including an annular body, wherein a circumferential portion of the biasing member annular body being connected with the second axial face diametrically opposite to a position where the extractor arm extends axially from the first axial face, and wherein the biasing member biases the first face against the head of a firearm bolt.

19. The firearm bolt of claim 18, further including a blast plate between the bolt head and bolt handle, wherein the cartridge extractor is positioned between the blast plate and a bolt head, the resiliently deformable biasing member engaging the blast plate and biasing and the first axial face engaging the bolt head.

20. The firearm bolt of claim 18, wherein the first axial face has a first axial face portion defining a first generally radial plane, and a second face portion defining a second generally radial plane, an intersection between the first axial face portion and the second face portion defining an ridge about which the annular body can pivot against the head of a firearm bolt, and wherein the biasing member biases the first axial face portion against the head of a firearm bolt.

21. The firearm bolt of claim 16, further including a cartridge engager flange at the engager end, the cartridge engager flange including a hook or claw, and a notch or channel adjacent the hook or claw, wherein the extractor arm extends from the first axial face portion along a longitudinal plane tangential with the outer curved surface.

22. The firearm bolt of claim 16, wherein the bolt handle includes a boss portion extending radially from the bolt body coincident with a plane intersecting a longitudinal axis of the bolt, a grippable portion extending from the boss portion at an acute angle to the plane, wherein the grippable portion is adjustable with respect to the boss portion between at least a first acute angle and a second acute angle different from the first acute angle.

23. The firearm bolt of claim 16, wherein the bolthead includes three locking lugs circumferentially spaced about the perimeter of the bolthead, and wherein the extractor arm extends along a channel between two adjacent locking lugs.

24. The firearm bolt of claim 16, wherein the first axial face has a first axial face portion defining a first generally radial plane, and a second face portion defining a second generally radial plane, an intersection between the first axial face portion and the second face portion defining the localised contact region about which the annular extractor body bears and pivots against a head of a firearm bolt.

* * * * *